US009957703B2

(12) United States Patent
Porter

(10) Patent No.: US 9,957,703 B2
(45) Date of Patent: May 1, 2018

(54) LAVATORY SYSTEMS

(75) Inventor: Patrick Porter, Hertfordshire (GB)

(73) Assignee: Washroom Wizard Ltd., Kent (GB)

( * ) Notice: Subject to any disclaimer, the term of this patent is extended or adjusted under 35 U.S.C. 154(b) by 483 days.

(21) Appl. No.: 13/000,048

(22) PCT Filed: Jun. 24, 2009

(86) PCT No.: PCT/GB2009/001594
§ 371 (c)(1),
(2), (4) Date: Feb. 24, 2011

(87) PCT Pub. No.: WO2009/156732
PCT Pub. Date: Dec. 30, 2009

(65) Prior Publication Data

US 2011/0138525 A1 Jun. 16, 2011

(30) Foreign Application Priority Data

Jun. 25, 2008 (GB) ..... 0811607.1
May 14, 2009 (GB) ..... 0908231.4

(51) Int. Cl.
*E03D 9/052* (2006.01)

(52) U.S. Cl.
CPC ..... *E03D 9/052* (2013.01)

(58) Field of Classification Search
CPC ..... E03D 9/04; E03D 9/05
USPC ..... 4/306, 213, 216, 219, 211, 209 FF
See application file for complete search history.

(56) References Cited

U.S. PATENT DOCUMENTS 3,763,505 A 10/1973 Zimmerman
4,166,298 A * 9/1979 Pearson ..... 4/213
5,361,422 A 11/1994 Vincent et al.
5,394,569 A * 3/1995 Poirier et al. ..... 4/213
6,088,845 A 7/2000 Estrada
(Continued)

FOREIGN PATENT DOCUMENTS

DE 19651076 A1 6/1998
EP 1830071 A 9/2007
(Continued)

OTHER PUBLICATIONS

Embpapst RLF 100 Series fan, Part No. 100-11/12, 2006.
(Continued)

*Primary Examiner* — Janie Loeppke
(74) *Attorney, Agent, or Firm* — Manelli Selter PLLC; Edward J. Stemberger

(57) ABSTRACT

An extraction system for removing unpleasant odor includes a housing having front and rear walls and side walls interconnecting the front and rear walls. The depth of the housing from the front to the rear wall is substantially less than distances across the front and rear walls from one side to the other thereof. A centrifugal fan is mounted to the housing with an axis of the fan being perpendicular to the rear wall. The fan has an axial air inlet located centrally of the front wall for receiving odor-laden air and an air outlet from the fan is tangential to the fan and coupled to discharge air to atmosphere from the extraction system. An absorbent filter unit is located within the housing downstream of the fan and includes an absorbent mass and a perfume source. Air discharged to atmosphere is both substantially free of the odor and scented via the absorbent filter unit.

4 Claims, 5 Drawing Sheets

(56) References Cited

U.S. PATENT DOCUMENTS

| | | | | |
|---|---|---|---|---|
| 6,643,850 | B2 * | 11/2003 | Chasen et al. | 4/213 |
| 6,760,928 | B1 | 7/2004 | Rodriguez | |
| 2002/0166162 | A1 * | 11/2002 | Romagna et al. | 4/306 |
| 2007/0189891 | A1 | 8/2007 | Herbst | |
| 2007/0256219 | A1 * | 11/2007 | Ellinger | 4/213 |
| 2008/0127403 | A1 * | 6/2008 | Iantorno et al. | 4/213 |

FOREIGN PATENT DOCUMENTS

| | | | |
|---|---|---|---|
| FR | 2593535 | A1 | 7/1987 |
| GB | 2178456 | A | 2/1987 |
| WO | 0061883 | A | 10/2000 |

OTHER PUBLICATIONS

GB Search Report in co-pending GB0910860.6, dated Oct. 19, 2009.
PCT Search Report in PCT/GB2009/001594, dated Nov. 5, 2009.
Examination Report in GB 0910860.6 dated Aug. 23, 2011.

* cited by examiner

LAVATORY SYSTEMS

BACKGROUND

This disclosure relates to lavatory systems.

Unpleasant odours are all too prevalent in lavatory systems, for example public lavatories, especially public urinals. While such systems will usually employ water traps to prevent sewer gas from infiltrating, odours upstream of the water trap have only been able to be dealt with heretofore by regular flushing of the water trap to remove accumulated urine and/soil, by attempting to mask the odour by other strong smells such as pine or naphthalene, or by ventilation as a whole of, and especially by air extraction from, the room (hereafter: "lavatory room") in which the lavatory system is installed.

The present disclosure adopts a quite different approach. As explained in more detail below with reference to specific embodiments, we seek to remove odour directly from its source.

SUMMARY OF THE DISCLOSURE

In accordance with a first aspect of this disclosure, there is provided an extraction system for a lavatory unit selected from urinals and toilet bowls, the lavatory unit including a receptacle for human liquid or solid waste, the receptacle having an outlet for such waste; the extraction system being adapted to extract odours from a region upstream of the receptacle outlet, and comprising: a shallow housing having front and rear walls, and side walls interconnecting the front and rear walls, the depth of the housing from the front to the rear wall being substantially less than distances across the front and rear walls from one side to the other thereof, the housing mounting a centrifugal fan with its axis perpendicular to the rear wall, the fan having an axial air inlet located centrally of the front wall and an air outlet generally tangential to the fan in a side wall of the housing, the housing being adapted for mounting with a ducting connection providing for airflow for odour-laden air from a region of the lavatory unit upstream of the receptacle outlet to the air inlet and with the air outlet being coupled to discharge air from the air outlet in a manner removing odour from the vicinity of the lavatory unit.

Where the lavatory unit has a water trap associated with the receptacle outlet, the housing is may be provided with two ducting connections, namely a first connection from a region of the lavatory unit upstream of the water trap to the air inlet and a second connection from the air outlet to the lavatory unit downstream of the water trap.

Accordingly, in a second and alternative aspect of this disclosure, there is provided an extraction system for a lavatory unit, selected from urinals and toilet bowls, of the kind including a water trap; the extractor system being adapted to extract odours from a region upstream of the water trap, and comprising: a shallow housing having front and rear walls and side walls interconnecting the front and rear walls, the depth of the housing from the front to the rear wall being substantially less than distances across the front and rear walls from one side to the other thereof, the housing mounting a centrifugal fan with its axis perpendicular to the rear wall, the fan having an axial inlet located centrally of the front wall and an outlet generally tangential to the fan in a side wall of the housing, the housing being adapted for mounting with a ducting connection from a region of the lavatory unit upstream of the water trap to the inlet and a ducting connection from the outlet to the lavatory unit downstream of the water trap.

Alternatively, the air outlet may be coupled to an absorbent filter unit adapted to absorb odour from air discharged from the extraction system via said air outlet to atmosphere. Suitably, the absorbent filter unit comprises a carbon filter, preferably capable of regeneration.

Whereas the housing is preferably adapted for mounting its rear wall to a generally vertical surface such as a wall or an internal surface of a water cistern, as explained below, it may be sufficient for the housing to be merely supported by the ducting to which it is coupled, so that no direct connection between the housing and any supporting surface may be required.

Where the outlet is coupled to a soil pipe, a non-return valve is suitably included in the ducting connection from the outlet to the soil pipe.

Where the lavatory unit comprises a receptacle in the form of a toilet bowl with a cistern, the housing may be mounted to a preferably generally vertical surface internally of the cistern above the maximum water level thereof. The ducting connection may comprise a pipe or hose coupled from a region of the toilet bowl adjacent its rim to the inlet. In this case the housing may simply be fitted to its ducting connections so as to be above the maximum water level of the cistern, without fixture to any surface of the cistern. Where the cistern has a flushing mechanism with a built-in overflow into the toilet bowl and a cistern lid with a seal, the inlet may simply be open to the interior of the cistern above its water line, and the ducting connection to the inlet may comprise the said built-in overflow.

In an alternative arrangement in which the lavatory unit comprises a receptacle in the form of a toilet bowl with a cistern having a flushing mechanism with a built-in overflow into the toilet bowl and a cistern lid with a seal, the housing may be mounted to a wall adjacent the cistern, and the ducting connection to the inlet may comprise a pipe coupled between the inlet and the water cistern above its maximum water level and the said built-in overflow. Alternatively, the housing may simply be fitted to the ducting connections without any direct fixing of the housing to the wall.

In installations in which the housing is mounted interiorly of a water cistern and the ducting connection from the outlet to the lavatory unit downstream of the water trap comprises piping connecting the outlet to the soil pipe via a non-return valve, power connection to a motor for the fan may be via wiring that extends from the said motor through said outlet and along said piping, issuing through the wall thereof, at a position upstream of the non-return valve, for electrical connection to a source of electric power.

Where the lavatory unit comprises a urinal with a urinal bowl having an outlet for urine therefrom, the housing is conveniently mounted to a wall alongside the urinal bowl, the ducting connection to the air inlet comprising piping tapping into plumbing for the urinal unit downstream of the outlet from the urinal bowl, and immediately above its water trap, where the urinal is fitted with a water trap, airflow of odour laden air from a region upstream of the urinal outlet being via that outlet, the said plumbing and the ducting connection to the air inlet. Where the urinal is fitted with a water trap, there may be ducting connection from the air outlet via piping coupling the air outlet to a waste pipe from the urinal unit connected to the downstream side of the water trap. Alternatively, the air outlet may simply be coupled to a said absorbent filter unit adapted to absorb odour from air discharged from the extraction system via said air outlet to atmosphere.

Where the lavatory unit comprises a urinal of the kind comprising a trough in which urine is collected before passing via an outlet comprising a drain from the trough and a water trap to a waste pipe, the housing is mounted to a wall, the ducting connection to the air inlet comprising piping tapping into plumbing for the urinal between the drain and the water trap. The air outlet may be coupled to a ducting connection comprising piping coupling the air outlet to the said waste pipe downstream of the water trap. Alternatively, the air outlet may simply be coupled to a said absorbent filter unit adapted to absorb odour from air discharged from the extraction system via said air outlet to atmosphere.

In the case of urinals, the fan preferably runs continuously, in which case, a non-return valve may be omitted. However, for added security to prevent back-flushing of sewer gas, should there be a power-cut, a non-return valve may be fitted regardless.

BRIEF DESCRIPTION OF THE DRAWINGS

Referring now to the accompanying drawings by way of example only.

DESCRIPTION OF PREFERRED EMBODIMENTS

Figure 1:
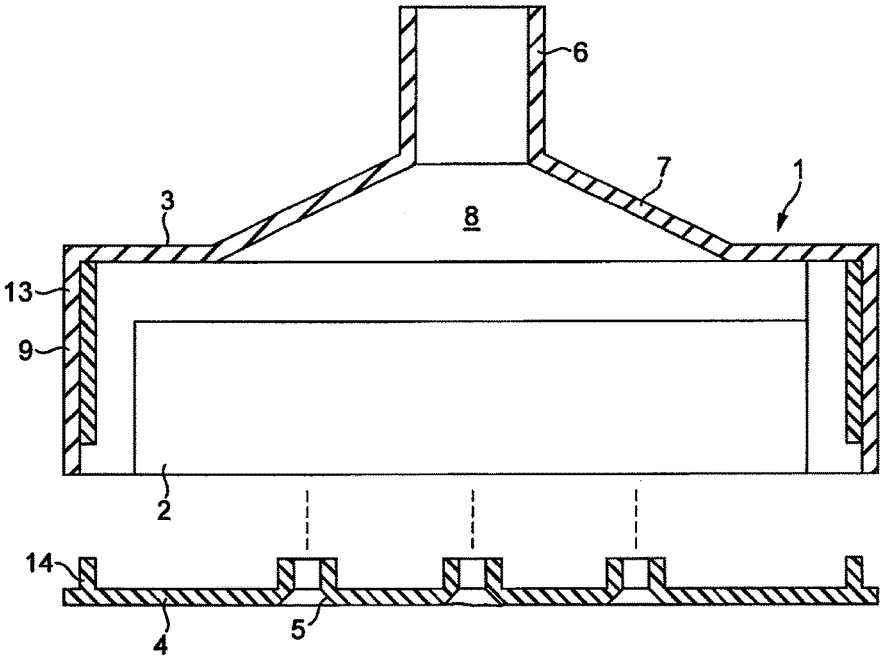
FIG. 1 shows an exploded sectional view of a fan and housing taken along the line I-I in FIG. 2.
Figure 2:
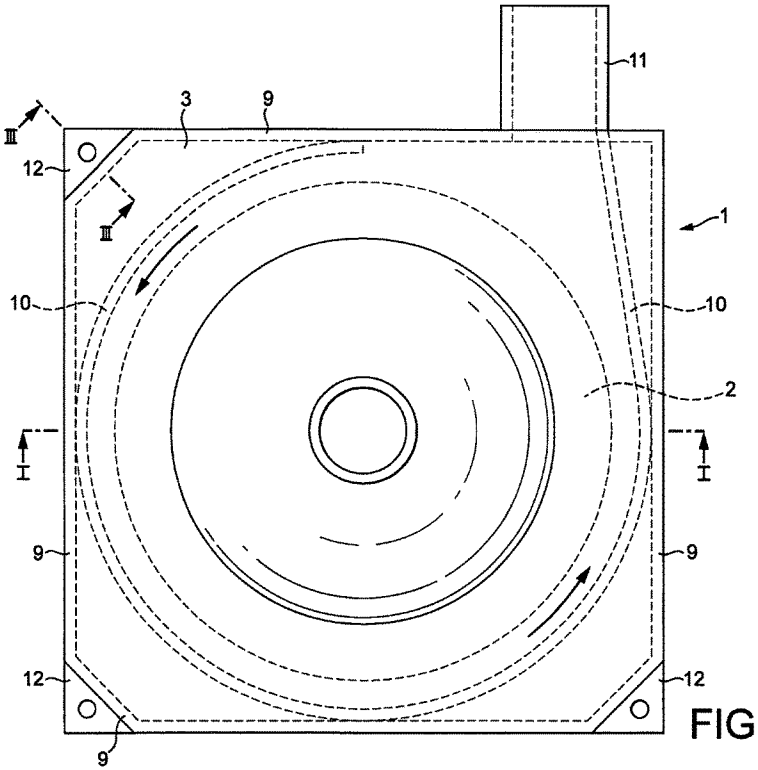
FIG. 2 is an elevational view of the fan and housing of FIG. 1 as seen in the direction of the arrow A in FIG. 1.

A shallow housing 1 for a centrifugal fan 2 is shown in FIGS. 1 and 2. The housing comprises a front wall 3 and a rear wall 4. Centrifugal fan 2 is preferably a radial blower. Suitable 12 volt DC radial blowers with electronically commutated external rotor motor are available from ebmpapst UK Ltd of Chelmsford, Essex under the trade designation REF 100-11/12, and have a total thickness of fan and motor of under 25 mm. The motor of fan 2 is mounted by screws to mounts 5 on rear wall 4. An inlet stub pipe 6 is mounted centrally of front wall 3 via a frustoconical portion 7 to define plenum 8 for inlet air on the inlet side of fan 2. The fan draws air in axially and ejects it in a tangential direction. The fan blades are preferably backwardly curved to reduce noise and increase efficiency. Side walls 9 extending perpendicular to the front wall extend from each edge of front wall 1 towards the rear wall. An interior wall 10 is mounted within a chamber effectively defined by the front wall and side walls to guide air flow towards an outlet stub pipe 11 mounted in one side wall. It will be seen that interior wall 10 follows the cylindrical profile of the fan at a fixed radial separation over three-quarters of a circumference before diverging to outlet 11. Front wall 3 is generally square apart from three of its four corners, which are cut-away. As best shown in the scrap sectional view of FIG. 3, apertured triangular flanges 12 are mounted to side walls 9 at their edges furthest from front wall 3 at positions corresponding to the cut-away corners. In practice the main portion 13 of housing 1, comprising the front wall with its sidewalls, the flanges and the interior wall may be moulded, for example from acrylic plastics, in one piece. Rear wall 4 forms a complete square with apertured corners corresponding to the positions of apertured flanges 12. A shallow upstanding wall 14 is integrally formed on rear wall 4, again by moulding the rear wall 4 in one piece, at positions just in board of the positions occupied by sidewalls 9 when the main portion 13 is offered up to rear wall 4 already mounting the fan 2 and motor. Fixings inserted through the apertures in flanges 12 and rear wall 4 enable the fan and its housing 1 to be mounted to a generally vertical surface. As can be seen from FIG. 1, the depth of the housing from the front to the rear wall is substantially less than distances across the front and rear walls from one side to the other.

Providing cut-away corners reduces the space occupied by the housing 1. Thus, the remaining corner may also be cut-away, although this is not shown in FIG. 2.

Figure 4:
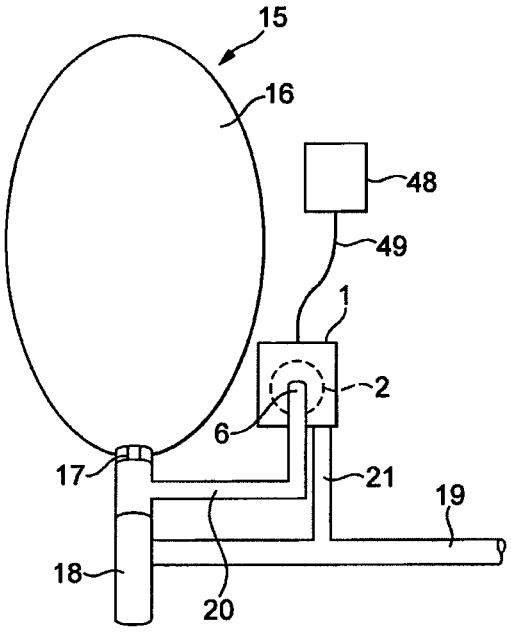
FIG. 4 is a generally schematic view of an embodiment of extraction system applied to a urinal.

Turning now to FIG. 4, a urinal 15 comprises a urinal basin 16 with a drain 17 from which urine, together with water used periodically to flush the urinal basin, passes via a conventional water trap 18 to a waste pipe 19. Urinal basin 16 will generally be mounted to a vertical wall. A housing 1 with fan 2 and motor is conveniently mounted alongside urinal basin 16 on the same wall. Ducting 20 is provided between a region upstream of the water trap and inlet 6 of housing 1. The ducting 20 here comprises piping tapped into the plumbing for the urinal unit below drain 17 immediately above its water trap 18. Ducting 21 connects outlet 11 with waste pipe 19 downstream of water trap 18.

Figure 5:
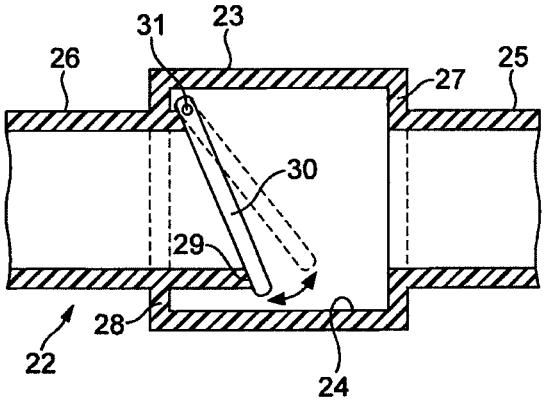
FIG. 5 is a longitudinal sectional view through a non-return valve.

The fan motor suitably runs continuously, avoiding reverse penetration of sewer gas, while substantially reducing the odour of urine without needing to mask it with another strong smell. However, for additional security against sewer gas, a non-return valve 22 may be incorporated in the system, suitably between the outlet 11 of housing 1 and waste pipe 19. As shown in FIG. 5, valve 22 comprises a generally cubic housing 23 defining a valve chamber 24 therewithin. Two stub pipes 25, 26 are coupled to housing 23. One stub pipe 25 is simply joined to one wall 27 of housing 23. The other penetrates through a wall 28 of the housing 23 opposite wall 27, its end 29 being cut at an angle. A flap valve 30 is pivoted at 31 so as to overlie cut end 29 by gravity. Air pressure created by fan 2 is sufficient to open flap valve 30 to allow odour-laden air to pass. When the motor stops, the flap valve will close cut end 29 preventing back flushing of sewer gas.

The system illustrated in FIG. 4 has the advantage that air extraction is applied to the region in which the odour is generated, so that significantly less power is consumed as compared with an extraction system seeking to reduce odour by ventilating the lavatory room as a whole. A typical motor for fan 2 has a consumption of 7.5 watts/hour.

The extraction system illustrated in FIG. 4 may be applied equally well to a urinal of the kind comprising a trough in which urine is collected before passing via a drain from the trough and a water trap to a waste pipe. In this case, housing 1 would be mounted to a convenient wall, the ducting connection to the inlet 6 comprising piping tapping into plumbing for the urinal between its drain and its water trap, and the ducting connection from the outlet 11 comprises piping coupling the outlet 11 to the said waste pipe downstream of the water trap.

Similar odour-reducing extraction may be applied to the toilet bowl of a water closet, as explained with reference to FIGS. 6 and 7.

Figure 6:
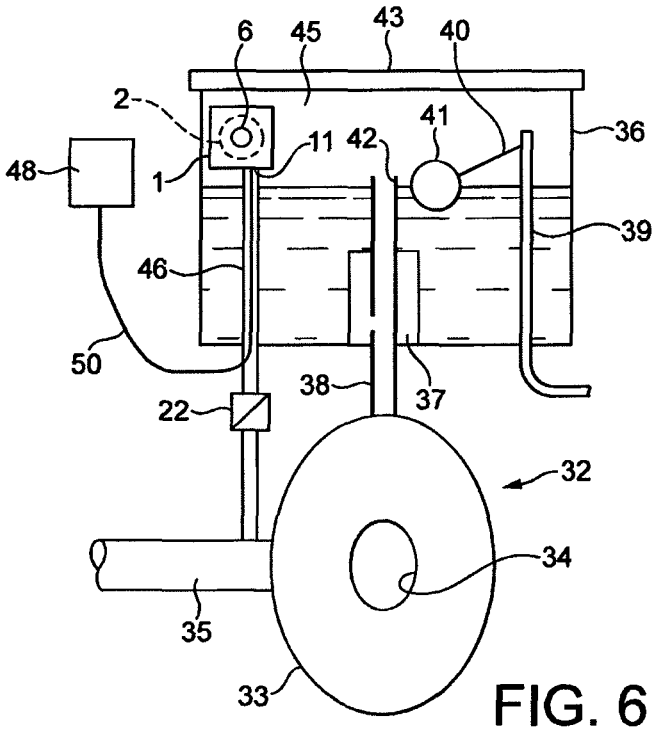
FIG. 6 is a generally schematic view of an embodiment of extraction system applied to a toilet bowl and cistern.

A water closet 32 is schematically illustrated in FIG. 6 and comprises a toilet bowl 33 with an outlet 34 to a conventional S-bend water trap exiting into a soil pipe 35. Toilet bowl 33 is flushed from a water cistern 36 by a flushing mechanism, indicated schematically at 37, which may be operated mechanically by a user (lever, press-button, etc) in conventional fashion or under automatic control (for example a proximity detector) again in a manner known per se, and is typically lifted to allow water within the cistern to pass through an opening into a conventional down pipe 38 issuing into toilet bowl 33 Cistern 36 has a water feed 39 from an external source controlled by a float valve 40, here a conventional ball-cock 41, which sets a maximum water level in the cistern. The flushing mechanism 37 here includes a built-in overflow 42 into the toilet bowl 33 via the normal flushing down pipe 38. The cistern 36 has a cistern lid 43 with a seal 44. In the arrangement of FIG. 6, the housing 1, with fan 2 and motor, is mounted to a generally vertical surface 45 internally of the cistern 36 above the maximum water level thereof. The inlet 6 is simply open to the air space above the water level in the cistern. The outlet 11 is coupled via piping 46 and a non-return valve 22 to soil pipe 35 downstream of the S-bend. Operation of the extractor unit creates a partial vacuum within the cistern drawing odour-laden air from the toilet bowl via ducting provided by the down pipe 38 and overflow pipe 42 into the airspace above the water line within the cistern and hence to inlet 6, the odour-laden air being exhausted via piping 46 to the soil pipe.

Rather than employing the overflow and normal down pipe, a housing 1 within the cistern 36 may be coupled by a separate pipe from the toilet bowl adjacent its rim to inlet 6.

Figure 7:
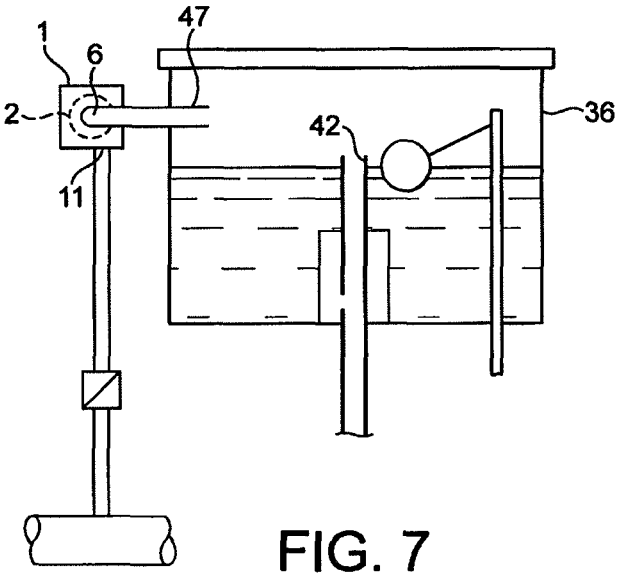
FIG. 7 is a generally schematic view of a variation of the extraction system of FIG. 6.

In another alternative arrangement shown in FIG. 7, housing 1 is mounted alongside cistern 36, inlet 6 being coupled to the air space above the water level in the cistern via a pipe 47 through the wall of the cistern.

Whereas urinal systems will normally operate continuously, toilet bowl systems may be set to operate only intermittently, for example by the motor being switched on for a set period from each operation of the flushing mechanism to exhaust odour-laden air from the bowl.

In the arrangements of FIGS. 4 and 7, there is no problem in supplying electric power to the fan motor. A suitable 12 volt transformer/adaptor 48 may be mounted at a convenient position and coupled to the mains power supply, wiring 49 providing DC power to the motor. With in-cistern installation of the housing 1, wiring 50 from transformer/adaptor 48 is conveniently fed into cistern 36 via piping 46 and outlet 11, as shown in FIG. 6.

As an alternative, in any of the above arrangements, to fixing the rear of the housing to a (preferably, generally vertical) surface such as a wall or an interior surface of a water cistern, the housing may simply be fitted to, and supported by, the ducting. In this case, the apertured flanges 12 may be omitted.

Because the preferred fan motors have such small power requirements in all the illustrated arrangements, several such motors may be coupled to a single transformer/adaptor. The adoption of a shallow housing 1 enables the housing to be mounted in an inconspicuous position against the wall of the lavatory room, or within the cistern itself as in the FIG. 6 arrangement.

Figure 3:
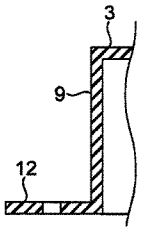
FIG. 3 is a scrap sectional view taken along the lines III-III in FIG. 2.
Figure 8:
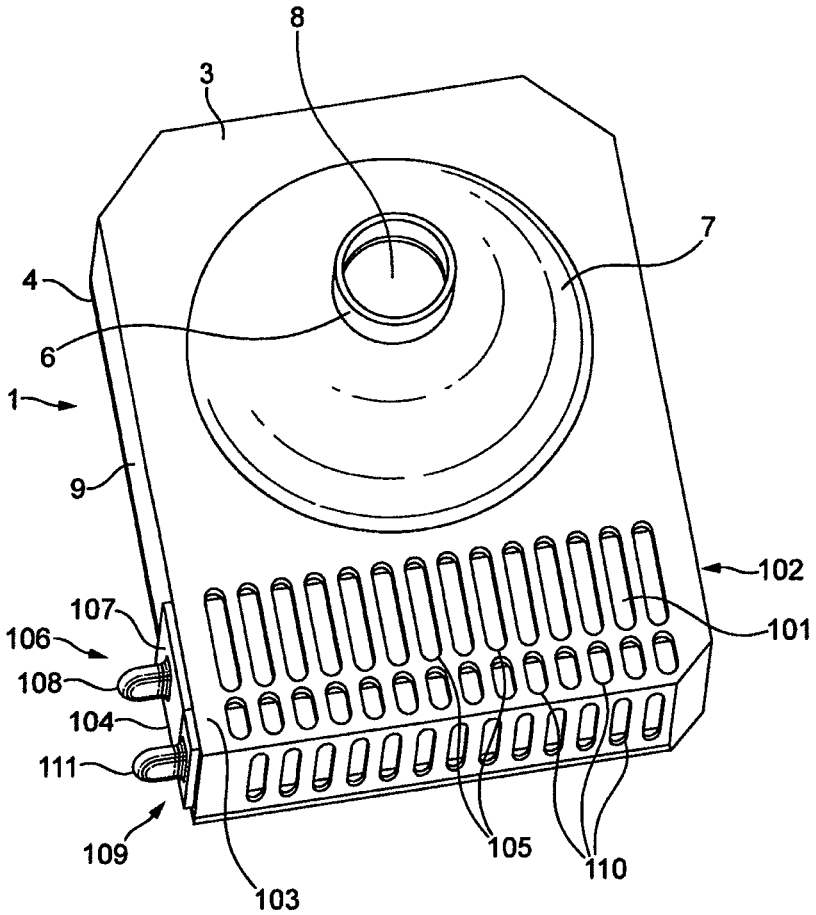
FIG. 8 shows an alternative embodiment of fan and housing with discharge of air from the air outlet of the extraction system via an absorbent filter unit to atmosphere.

For ease of comparison, parts of the extraction system shown in the embodiment of FIG. 8 that correspond to parts of the extraction systems illustrated in FIGS. 1, 2 and 3 are identified with like reference numerals.

In FIG. 8, a shallow housing 1 for a centrifugal fan (not shown, but identically mounted to the fan of FIGS. 1 to 3) comprises a front wall 3 and a rear wall 4. An air inlet stub pipe 6 is mounted centrally of front wall 3 via a frustoconical portion 7 to define plenum 8 for inlet air on the inlet side of the fan. The fan draws air in axially and ejects it in a tangential direction. Side walls 9 extending perpendicular to the front wall extend from each edge of front wall 1 towards the rear wall. Rather than being provided with an outlet stub pipe serving as an air outlet, as in the embodiment of FIGS. 1 to 3, in the present embodiment, tangentially driven air from the centrifugal fan issues into an absorbent mass 101 contained within a filter housing 102 defined between extended portions 103 and 104 of the front and rear walls 3 and 4. In this embodiment filtered air is discharged to atmosphere through a grille 105 formed in the extended top wall 103. Absorbent mass 101 is suitably a carbon filter. The carbon filter may be provided in the form of a replaceable filter cartridge 106, as illustrated, in which the filter mass 101 is mounted to an end wall 107 fitted with a tab 108. When the filter mass is full, a user may simply withdraw the cartridge from the housing 102 by pulling on tab 108. In the case of a carbon filter, the cartridge can be regenerated by heating to drive off the trapped odour molecules, and can then be re-used. Optionally, as shown, there may be a second cartridge 109 behind a further grille 110, and with a similar tab 111 for removing and replacing it. Cartridge 109 may contain a perfume.

Variations are possible. Whereas the filter and the optional perfume source are here mounted within the same housing as the fan, which provides a particularly compact construction, this is not necessary. The filter could be coupled to the fan housing air outlet by ducting to discharge filtered air to atmosphere at a position remote from the fan housing.

Apart from discharge of filtered air to atmosphere, either in the immediate vicinity of the fan housing, as in the above illustrated arrangement, or at a remote position, as in the above described variation, the extraction system may be mounted to urinals or lavatories in all the ways described and illustrated in FIGS. 4, 6 and 7.

The invention claimed is:

1. An extraction system for removing unpleasant odor, and comprising:

a centrifugal fan having an axis and being constructed and arranged to provide an axial-in, tangential-out airflow, a housing mounting the fan, the housing having front and rear walls and walls interconnecting the front and rear walls, the fan being mounted with the axis perpendicular to the rear wall, the depth of the housing from the front to the rear wall being substantially less than distances in all directions across the front and rear walls, whereby the housing is shallow from front to rear, the rear wall being constructed and arranged to be mounted to a confronting surface selected from a building wall and an internal surface of a water cistern, an air inlet for the fan located in the front wall of the housing for receiving odor-laden air in confronting relation to the fan axis, an absorbent filter unit located within said housing downstream of the fan, and positioned to receive air exiting tangentially from the fan for discharge to atmosphere via the absorbent filter unit, the absorbent filter unit comprising an absorbent carbon filter mass, and a perfume source also located within said housing, whereby air discharged to atmosphere is both substantially free of said odor and scented, the absorbent carbon filter mass being removable from the housing independently of the perfume source for regeneration by heating, and the perfume source being located within an accessible chamber within the housing for removal and replacement of the perfume source when spent.

2. The extraction system according to claim 1, for a lavatory unit, selected from urinals and toilet bowls, of the kind including a water trap; the extraction system being adapted to extract odors from a region upstream of the water trap, and being provided with a ducting connection from a region of the lavatory unit upstream of the water trap to the inlet.

3. A lavatory installation, comprising a lavatory unit and an extraction system for removing unpleasant odor from the lavatory installation; the extraction system, comprising:

a centrifugal fan having an axis and being constructed and arranged to provide an axial-in, tangential-out airflow, a housing mounting the fan, the housing having front and rear walls and walls interconnecting the front and rear walls, the fan being mounted with the axis perpendicular to the rear wall, the depth of the housing from the front to the rear wall being substantially less than distances in all directions across the front and rear walls, whereby the housing is shallow from front to rear, an air inlet for the fan located in the front wall of the housing for receiving odor-laden air in confronting relation to the fan axis, an absorbent filter unit located within said housing downstream of the fan, and positioned to receive air exiting tangentially from the fan for discharge to atmosphere via the absorbent filter unit, the absorbent filter unit comprising an absorbent carbon filter mass, and a perfume source also located within said housing, whereby air discharged to atmosphere is both substantially free of said odor and scented, the absorbent carbon filter mass being removable from the housing independently of the perfume source for regeneration by heating, and the perfume source being located within an accessible chamber within the housing for removal and replacement of the perfume source when spent, wherein the rear wall of the housing is mounted to a generally vertical surface selected from a building wall associated with the installation and an internal surface of a water cistern, and wherein said lavatory unit comprises a receptacle in the form of a toilet bowl provided with a cistern, wherein a ducting connection is provided to the air inlet, the ducting connection comprising a pipe or hose coupled from a region of the toilet bowl adjacent its rim to the inlet.

4. The lavatory installation according to claim 3, wherein the cistern has a flushing mechanism with a built-in overflow into the toilet bowl and a cistern lid with a seal, the inlet being open to the interior of the cistern above its water line, and the ducting connection to the inlet comprising the said built-in overflow.

* * * * *